United States Patent [19]

Salmond et al.

[11] 4,095,230

[45] June 13, 1978

[54] HIGH ACCURACY BROADBAND ANTENNA SYSTEM

[75] Inventors: William E. Salmond, Fullerton; Ronald L. Auletti, Alta Loma, both of Calif.

[73] Assignee: General Dynamics Corporation, Pomona, Calif.

[21] Appl. No.: 803,710

[22] Filed: Jun. 6, 1977

[51] Int. Cl.[2] ..... H01Q 19/12; H01Q 1/36

[52] U.S. Cl. ..... 343/729; 343/840; 343/895

[58] Field of Search ..... 343/726, 727, 729, 730, 343/840, 895

[56] References Cited

U.S. PATENT DOCUMENTS

| | | | |
|---|---|---|---|
| 3,445,850 | 5/1969 | Stegen | 343/840 |
| 3,550,135 | 12/1970 | Bodmer | 343/725 |
| 4,015,264 | 3/1977 | Koerner | 343/895 |

*Primary Examiner*—Eli Lieberman

*Attorney, Agent, or Firm*—Neil F. Martin; Edward W. Callan; Edward B. Johnson

[57] ABSTRACT

A high accuracy broadband antenna system is disclosed. This system is a dual mode system which includes a parabolic reflector dish having a dielectric substrate and a conductive material coating on the substrate; an antenna feed positioned at the focus of the paraboloid and directed at the reflector dish for providing a narrow beam monopulse radiation pattern; and a circuit for coupling energy to and/or from the antenna feed. The conductive material coating on the reflector dish substrate defines a plurality of conductive spiral arms for providing a wide beam monopulse radiation pattern; and the antenna system further includes structure defining a cavity for backing the conductive spiral arms and a circuit for coupling energy to and/or from the conductive spiral arms, whereby the parabolic reflector dish is operable as a primary antenna providing a wide beam radiation pattern.

The dual mode antenna system is included in a missile guidance system, wherein the wide beam radiation pattern may be used for initial target acquisition, and the narrow beam radiation pattern may be used for tracking the target very accurately. This broadband antenna system is operable over a greater-than-9:1 bandwidth frequency range.

16 Claims, 10 Drawing Figures

HIGH ACCURACY BROADBAND ANTENNA SYSTEM

BACKGROUND OF THE INVENTION

The present invention generally pertains to antenna systems and is particularly directed to antenna systems for use in missile guidance systems.

An antenna system which is used for tracking targets is included in a guidance system of a missile which is intended to seek out and destroy electromagnetic radiation sources, such as enemy search and guidance control radar systems. In order to counteract the threat of early shutdown of target radiation sources, future generation antiradiation missiles must be equipped with more highly accurate seeker antenna systems for tracking target radiation sources. This implies a need for a significant reduction (by approximately an order of magnitude) in the boresight error of the antenna system and also a significant reduction in the radome error slope.

In a typical antiradiaton missile, a seeker antenna system is positioned within the radome at the nose of the missile. The seeker antenna system is used to detect a radiation source, whereupon the guidance system responds to such detection by causing the missile to home in on the radiation source. In one type of antiradiation missile guidance system, the seeker antenna system is a planar multi-arm spiral antenna which is gimballed for movement throughout a conical angle within the radome. The radiation field covered by the antenna is ahead of the missile and centered about the boresight axis of the missile. The angular deviation of the electrical boresight of an antenna from its reference boresight is known as boresight error. A significant factor contributing to boresight error is the presence of the radome, since wavefronts passing through the radome to the antenna are somewhat distorted. The radome error slope is the variation in boresight error as a function of the look angle of the antenna through the radome.

It is a principal object of the present invention to provide a monopulse antenna system for use in a missile guidance system, wherein the boresight error and the radome error slope of the antenna system are significantly reduced.

SUMMARY OF THE INVENTION

The antenna system of the present invention provides the higher degree of accuracy desired for a broadband seeker antenna system to be used in a future generation antiradiation missile.

The antenna system of the present invention includes a parabolic reflector dish having a dielectric substrate and a conductive material coating on the substrate; an antenna feed positioned at the focus of the paraboloid and directed at the reflector dish for providing a narrow beam radiation pattern; and a circuit for coupling energy to and/or from the antenna feed; and is characterized by the conductive material coating on the reflector substrate defining a plurality of conductive spiral arms for providing a wide beam radiation pattern; and by structure defining a cavity for backing the conductive spiral arms on the reflector substrate. Accordingly, the seeker antenna is operable in one mode as a spiral antenna, providing a wide beam radiation pattern; and functions in another mode as a parabolic reflector in combination with the antenna feed so as to provide a narrow beam radiation pattern.

Thus, the present invention is a dual mode antenna system wherein the wide beam radiation pattern may be used for initial target acquisition by a missile guidance system and the narrow beam radiation pattern may be used for high accuracy target tracking.

With the narrow beam provided by the large aperture parabolic reflector antenna, boresight errors and radome error slopes are significantly reduced, since the wavefront distortion due to the presence of the radome is averaged over a much larger baseleg than with a planar spiral antenna, such as is used in present generation missile guidance systems. Also, the narrow beam pattern provides increased antenna angle gain sensitivity which, in turn, reduces the boresight error magnitude in comparison with current state-of-the-art missile guidance antenna systems.

Also, because the broad beam pattern and narrow beam pattern are provided by a single dual mode antenna system that inherently provides both patterns about a single axis, boresight deviations between the two antenna systems are minimized.

In addition, the dual mode antenna system of the present invention provides for increased bandwidth operation at both the high and low ends of currently used multi-octave frequency bands.

Additional features of the present invention are described hereinbelow in the Description of the Preferred Embodiment.

DESCRIPTION OF THE PREFERRED EMBODIMENT

Figure 1:
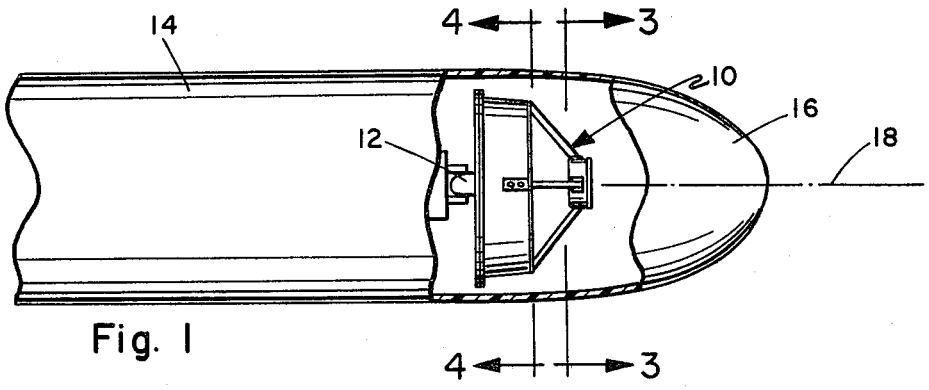
FIG. 1 illustrates the nose portion of a missile, with a portion of the wall cut away to show the dual mode antenna system of the present invention installed in the missile.
Figure 2:
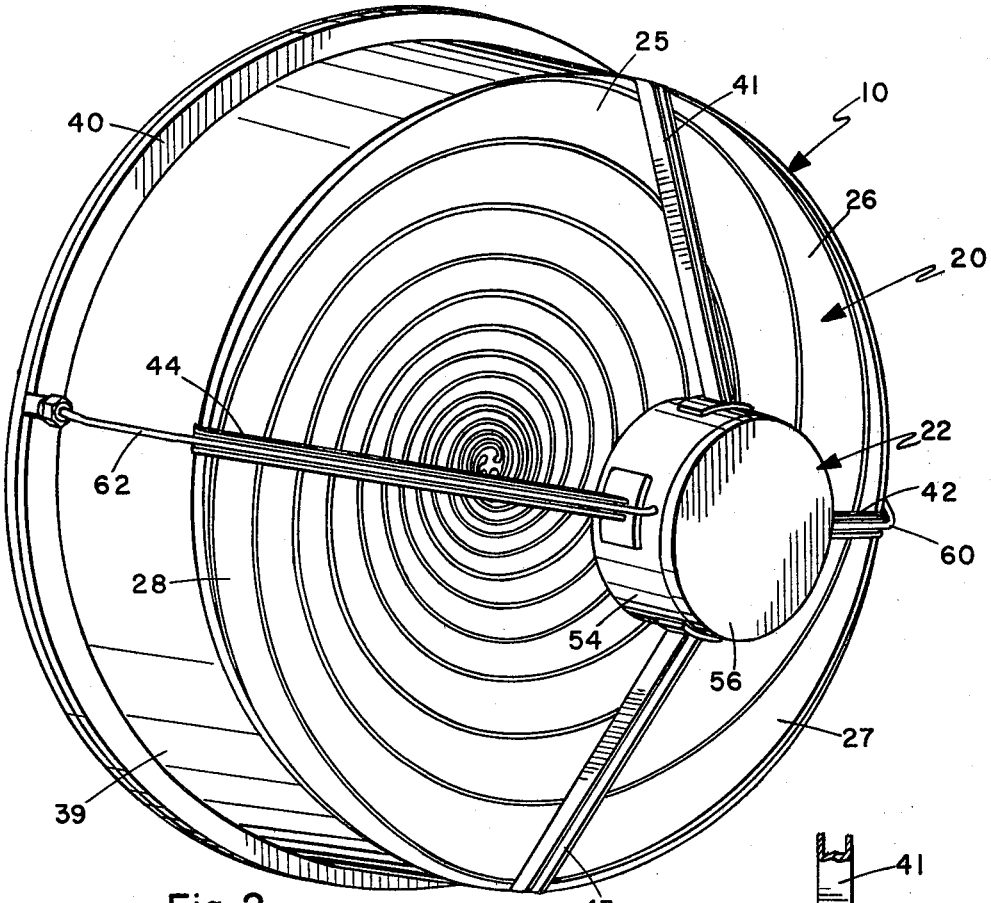
FIG. 2 is a perspective view of a preferred embodiment of the dual mode antenna system of the present invention.
Figure 3:
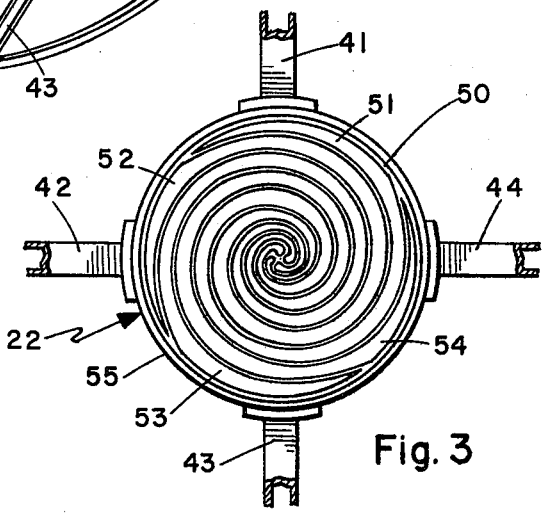
FIG. 3 is an enlarged sectional view of a portion of the preferred embodiment of FIG. 2 taken on line 3—3 of FIG. 1.
Figure 4:
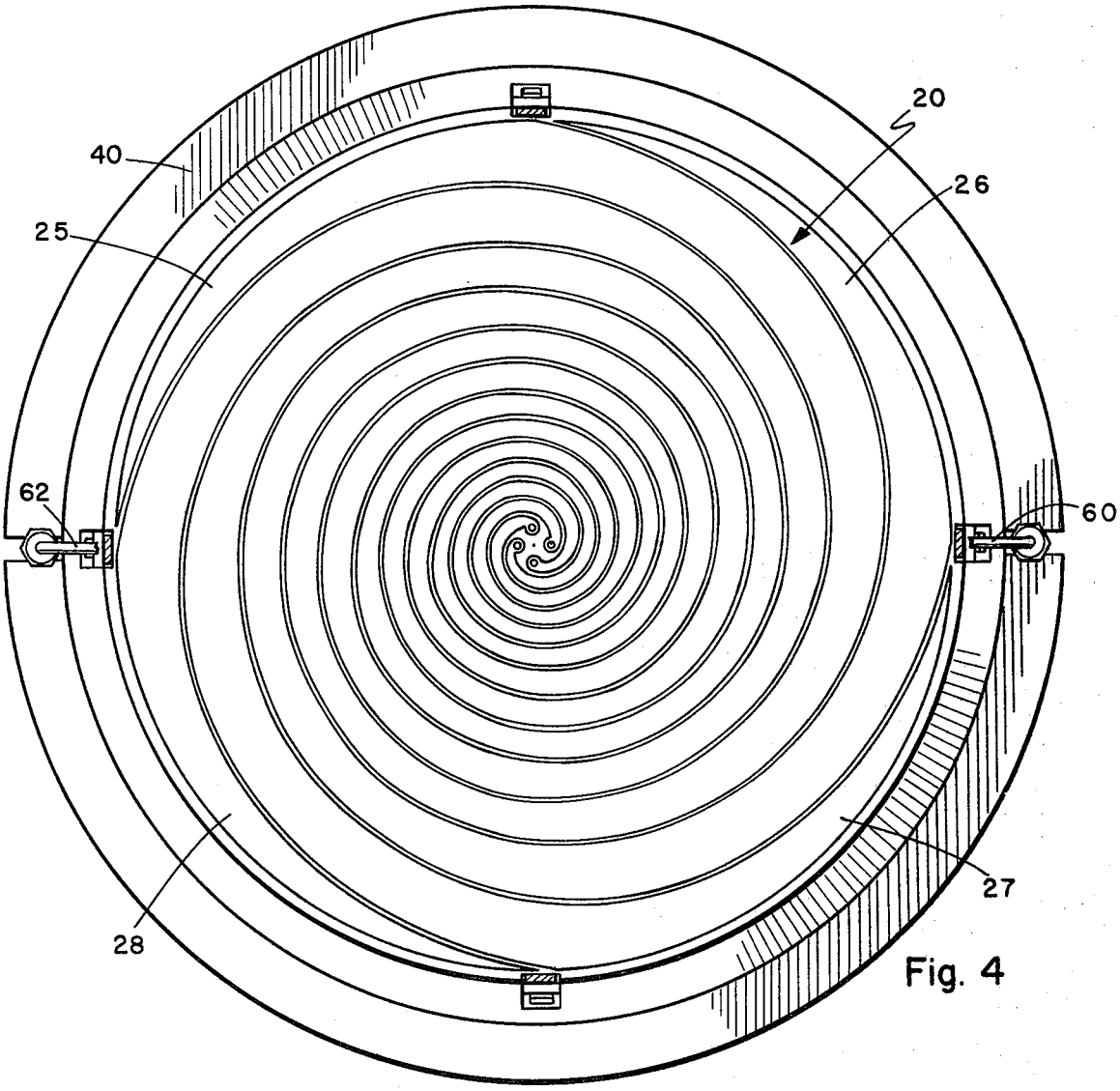
FIG. 4 is an enlarged sectional view of a portion of the preferred embodiment of FIG. 2 taken on line 4—4 of FIG. 1.
Figure 5:
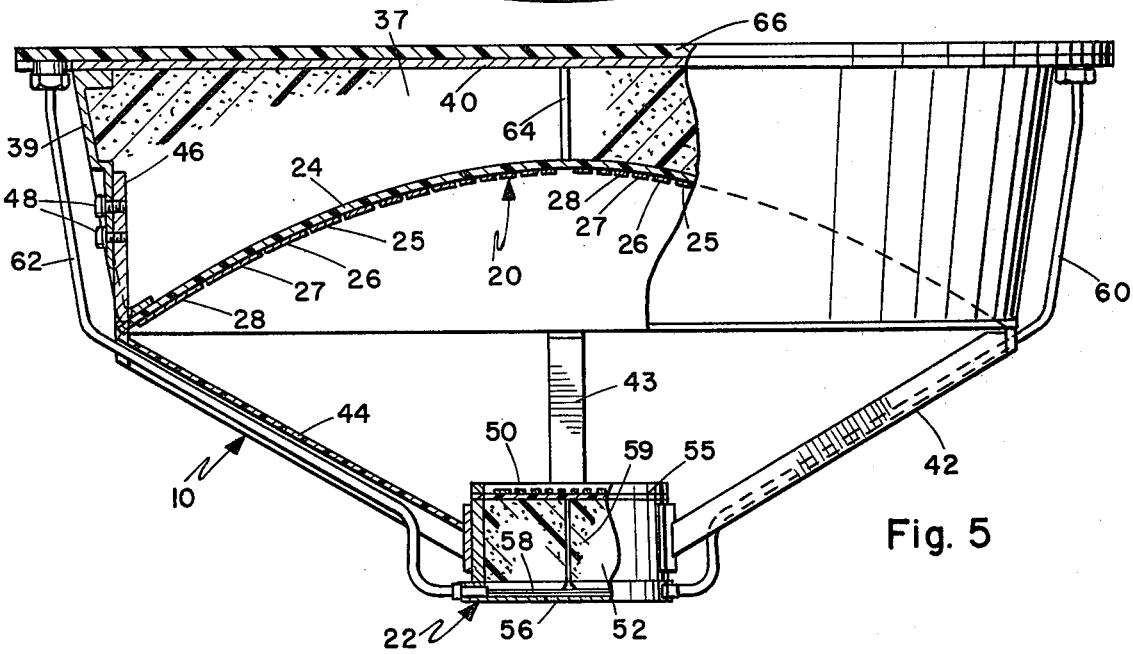
FIG. 5 is a top plan view of the preferred embodiment of FIG. 2 with portions cut away.

The antenna system 10 is shown in FIG. 1 as being supported for movement on a gimballing system 12 within the nose portion of a missile 14. The antenna system 10 is positioned within a radome 16, and gimballed for movement throughout a conical angle within the radome 16. The radiation field covered by the antenna system 10 is ahead of the missile 14 and centered about the boresight axis of the missile 14.

Referring to FIGS. 2, 3, 4 and 5, the antenna system 10 includes a circular, parabolic reflector dish 20, and an antenna feed 22 which is positioned at the focus of the paraboloid.

The paraboloid reflector dish 20 includes a dielectric substrate 24. A conductive material coating on the substrate 24 defines a plurality of conductive spiral arms 25, 26, 27 and 28. It has been determined from the standpoint of ease of design and performance that the preferred number of spiral arms is four. The spiral arms 25, 26, 27 and 28 are displaced 90° with respect to each other.

The spiral arms 25, 27, 28 define logarithmic spirals. Preferably all four spiral arms 25, 26, 27, 28 are on the same side of the substrate 24. In order to provide optimum relfectance, the circumferential arm width of each spiral arm 25, 26, 27, 28 varies from approximately 30° near the center of the spiral to approximately 87° at the outer edge of the spiral.

Figure 10:
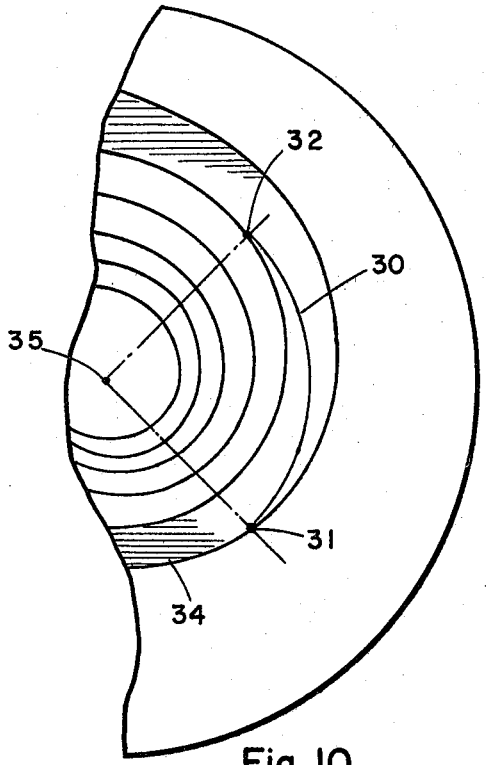
FIG. 10 is a view of a portion of a spiral arm pattern for illustrating how the circumferential arm width of a spiral arm is measured.

The circumferential arm width is the angle of an arc from the leading edge of the spiral arm to the trailing edge of a spiral arm that is defined by a circle intersecting with such edges and having a center in common with the spiral. Measurement of circumferential arm width is illustrated in FIG. 10. The measurement is taken along the arc 30 between the leading edge 31 and the trailing edge 32 of the spiral arm 34 that is defined by a circle having a center 35 in common with that of the spiral arm 34.

The parabolic reflector dish 20 is backed by a cavity 37 to assure that radiation from the parabolic reflector dish 20 is substantially in only the forward direction. The cavity 37 is defined by an aluminum shroud 39 and an aluminum mating plate 40. The cavity 37 is loaded with a multilayer radiation absorbing material, such as foam rubber loaded with graphite. The dielectric constant and loss tangent of the absorbing material in the cavity 37 varies from free space conditions at the interface with the parabolic reflector dish 20 to very high values near the mating plate 40.

The antenna feed 22 is supported by four struts 41, 42, 43 and 44, each of which is attached to the shroud 39 by a brace 46 and screws 48. The struts 41, 42, 43, 44 are made of dielectric material. The antenna feed includes a cavity-backed, planar multi-arm spiral antenna 50 (see FIGS. 3 and 5). The feed antenna 50 has four uniformly spaced spiral arms 51, 52, 53 and 54 defining logarithmic spirals.

The feed antenna 50 is backed by a cavity 52 defined by an aluminum shroud 55 and a mating plate 56. The cavity 52 also is filled by radiation absorbing material.

The antenna feed 22 includes a signal processing network 58. The signal processing network 58 is of stripline construction and is mounted on the front of the mating plate 56. Signals are coupled between the spiral arms of the feed antenna 50 and the processing network 58 by feed lines 59. Two semi-rigid coaxial cables 60 and 62, which are supported by the struts 42 and 44, are connected to the signal processing network 58.

Feed lines 64 are connected between the conductive spiral arms 25, 26, 27, 28 of the parabolic reflector dish 20 and a signal processing network 66. The signal processing network 66 is of stripline construction and is mounted on the back of the mating plate 40. When the parabolic reflector dish 20 is used as a primary antenna, signals are coupled between the conductive spiral arms 25, 26, 27, 28 and the signal processing network 66 by the feed lines 64.

In the preferred embodiment, the antenna system 10 is operated as a dual mode monopulse seeker antenna in a missile guidance system. The parabolic reflector dish 20 cooperates with the antenna feed 22 to receive radiation in a narrow beam pattern. Sum and difference signals are provided by the signal processing network 58 in response to radiation received by the feed antenna 50 in the narrow beam pattern. The sum signal is provided on the coaxial cable 60 and the difference signal is provided on the coaxial cable 62.

The parabolic reflector dish 20 also is operated as a primary antenna to receive radiation in a wide beam pattern. Sum and difference signals are provided by the signal processing network 66 in response to radiation received by the parabolic reflector dish 20 in the wide beam pattern.

Preferably the antenna system 10 is operated in the wide beam pattern mode for use in initial target acquisition by the missile guidance system, and is operated in the narrow beam pattern mode for use in highly accurate target tracking.

In the preferred embodiment, the diameter of the parabolic reflector dish 20 is approximately 9 inches (23 cm), and the diameter of the planar feed antenna 50 is approximately 2 inches (5 cm). When operating in the narrow beam mode, boresight errors of less than ±0.5° were maintained. This broadband antenna system is operable over a greater than 9:1 frequency range.

Figure 6:
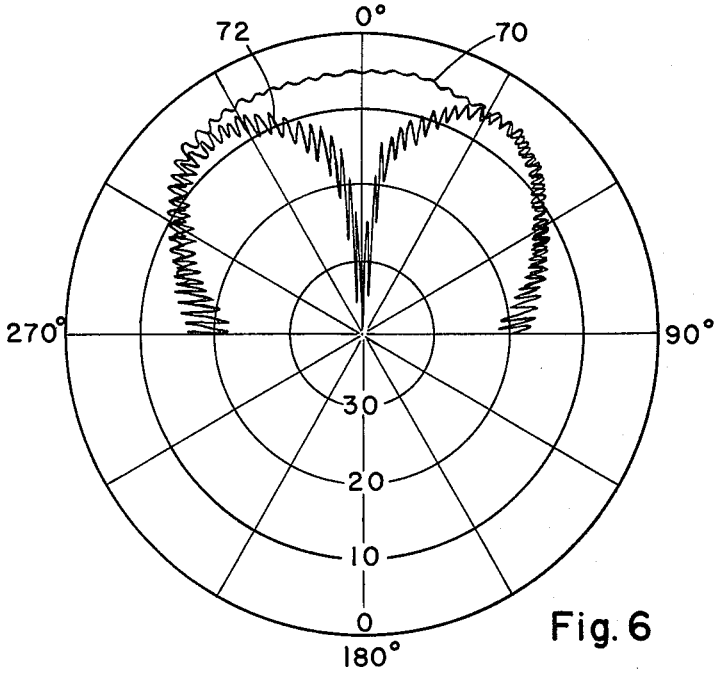
FIG. 6 is a typical wide beam radiation pattern for the antenna system of FIG. 2, plotted in polar coordinates, with the amplitude in dB.
Figure 7:
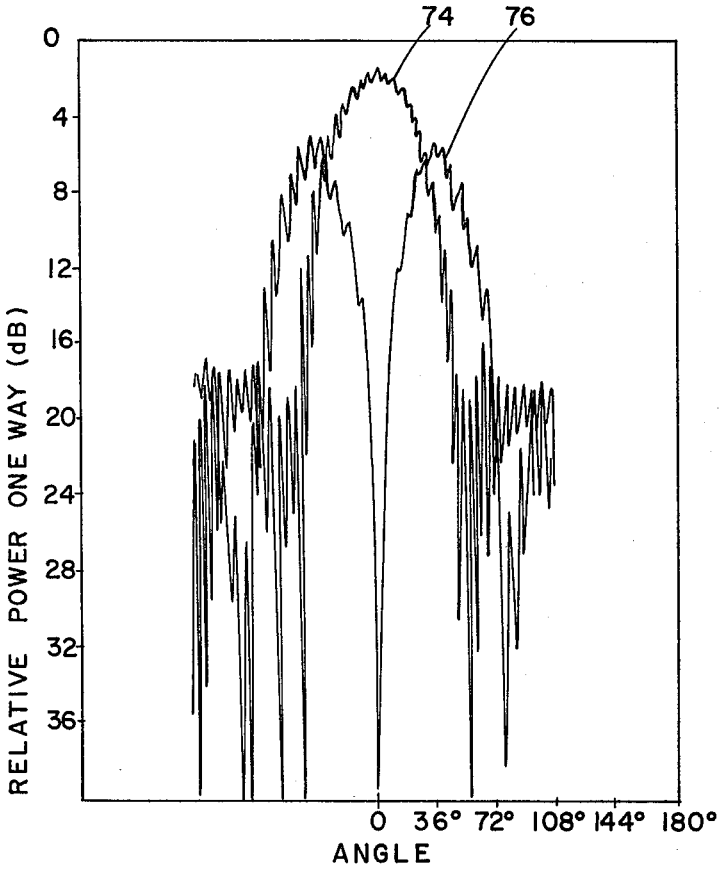
FIG. 7 is a typical narrow beam radiation pattern for the antenna system of FIG. 2, plotted in rectangular coordinates, with the amplitude in dB.

A wide beam radiation pattern for the preferred embodiment of FIGS. 2, 3, 4 and 5 is shown in FIG. 6. A sum signal waveform 70 and a difference signal waveform 72 are illustrated. The data was taken with a rotating linear source to demonstrate circularity. A typical narrow beam radiation pattern for this antenna system is illustrated in FIG. 7. A sum signal waveform 74 and a difference signal waveform 76 are shown. This data also was taken with a rotating source. The effect upon the narrow beam radiation pattern caused by the surface of the parabolic reflector dish 20 not being completely coated with conductive material, so as to provide an approximately continuous reflective shell, is a slight reduction in overall antenna gain and a slight increase in the sidelobe level.

In an alternative preferred embodiment of the present invention, interleaved conductive spiral arms may be disposed on each side of the parabolic reflector dish substrate. A uniform number of interleaved spiral arms are defined by the conductive material on each side of the parabolic reflector dish substrate. The spiral arms on each side of the substrate are evenly spaced. Preferably the spaced interleaved spiral arms on one side of the substrate complements the spacing of the interleaved spiral arms on the other side of the substrate to provide an apparently continuous conductive shell for reflecting radiation.

Figure 8:
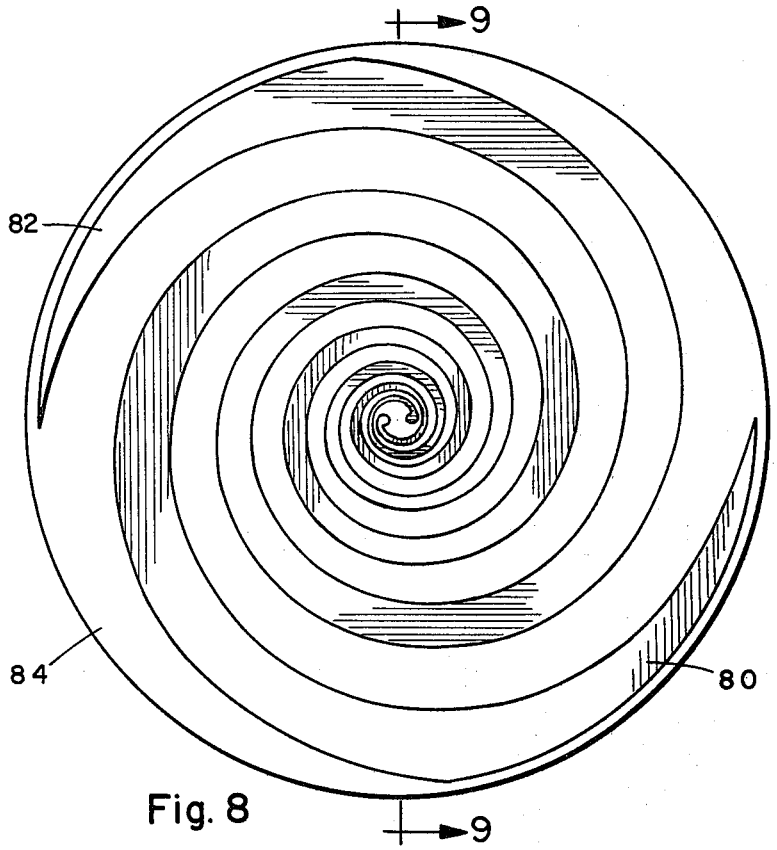
FIG. 8 is a plan view of an alternative preferred embodiment of the parabolic reflector dish.
Figure 9:
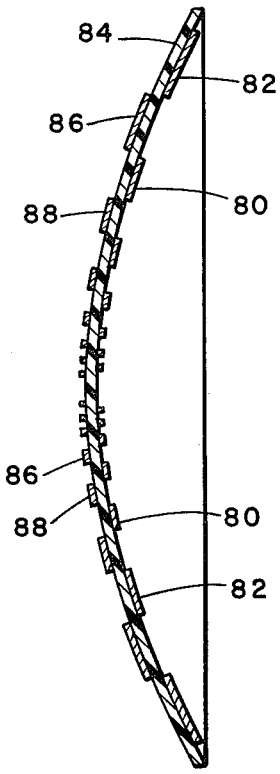
FIG. 9 is a sectional view taken on line 9—9 of FIG. 8.

In an alternative preferred embodiment of the parabolic reflector dish illustrated in FIGS. 8 and 9, two interleaved spiral arms 80, 82 are defined by conductive material on the front side of the parabolic reflector dish substrate 84; and two interleaved spiral arms 86, 88 are defined on the back side of the substrate 84. The spiral arms 80, 82, 86, and 88 on each side of the substrate 84 respectively are displaced 180° with respect to each other and 90° with respect to the spiral arms on the opposite side of the substrate 84. The circumferential arm width of the spiral arms 80, 82, 86 and 88 is approximately 90° throughout, so as to provide an apparently continuous reflective shell.

Having described our invention, we now claim:

1. An antenna system comprising, a parabolic reflector dish having a dielectric substrate and a conductive material coating on the substrate, antenna feed means positioned at the focus of said paraboloid and directed at the reflector dish for providing a narrow beam radiation pattern, and means for coupling energy to and/or from the antenna feed means, wherein the improvement comprises, the conductive material coating on the reflector dish substrate defining a plurality of conductive spiral arms for providing a wide beam radiation pattern, means defining a cavity for backing the conductive spiral arms, and means for coupling energy to and/or from the conductive spiral arms on the reflector dish substrate, whereby the parabolic reflector dish is operable as a primary antenna providing a wide beam radiation pattern.

2. A system according to claim 1, wherein four evenly spaced interleaved spiral arms are defined by the conductive material on the dielectric substrate.

3. A system according to claim 2, wherein the spiral arms are displaced 90° with respect to each other.

4. A system according to claim 3, wherein the four spiral arms are on the same side of the parabolic reflector dish substrate.

5. A system according to claim 4, wherein the spirals are logarithmic and the circumferential arm width of each spiral arm varies from approximately 30° near the center of the spiral to approximately 87° at the outer edge of the spiral.

6. A system according to claim 2, wherein two spaced interleaved spiral arms are defined on each side of the dielectric substrate by the conductive material.

7. A system according to claim 6, wherein the spiral arms on each side of the dielectric substrate are displaced 180° with respect to each other and 90° with respect to the spiral arms on the opposite side thereof.

8. A system according to claim 1, wherein a uniform number of evenly spaced interleaved spiral arms are defined on each side of the dielectric substrate by the conductive material.

9. A system according to claim 8, wherein the spacing of the interleaved spiral arms on one side of the substrate complements the spacing of the interleaved spiral arms on the other side of the substrate to provide an apparently continuous conductive shell for reflecting radiation.

10. A system according to claim 1, wherein the antenna feed means positioned at the focus of the paraboloid comprises a cavity backed planar multi-arm antenna.

11. A dual mode antenna system for a missile guidance system comprising, a parabolic reflector dish having a dielectric substrate and a conductive material on the substrate for reflecting radiation, wherein the conductive material on the reflector dish substrate defines a plurality of conductive spiral arms for providing a wide beam radiation pattern, means defining a cavity for backing the conductive spiral arms on the reflector dish substrate, means for coupling energy to and/or from the conductive spiral arms on the reflector dish substrate, whereby the parabolic reflector dish is operable as a primary antenna providing a wide beam radiation pattern for use in initial target acquisition by said missile guidance system, antenna feed means positioned at the focus of said paraboloid and directed at the reflector dish for providing a narrow beam radiation pattern for use in high accuracy target tracking, and means for coupling energy to and/or from the antenna feed means.

12. A system according to claim 11, wherein the antenna feed means positioned at the focus of the paraboloid comprises a cavity backed planar multi-arm spiral antenna.

13. A system according to claim 11, wherein four evenly spaced interleaved spiral arms are defined by the conductive material on the dielectric substrate.

14. A system according to claim 13, wherein the spiral arms are displaced 90° with respect to each other.

15. A system according to claim 14, wherein the four spiral arms are on the same side of the parabolic reflector dish substrate.

16. A system according to claim 15, wherein the spirals are logarithmic and the circumferential arm width of each spiral arm varies from approximately 30° near the center of the spiral to approximately 87° from the outer edge of the spiral.

* * * * *